US006103335A

United States Patent [19]

Zöller et al.

[11] Patent Number: 6,103,335

[45] Date of Patent: Aug. 15, 2000

[54] CORNER-PROTECTION PAD

[75] Inventors: Michael Zöller, Siegen; Heiko Hummel, Neckarsulm; Volker Schumacher, Öhringen, all of Germany

[73] Assignee: Storopack Hans Reichenecker GmbH + Co., Weinstadt, Germany

[21] Appl. No.: 08/945,154

[22] PCT Filed: Apr. 17, 1996

[86] PCT No.: PCT/EP96/01601

§ 371 Date: Dec. 22, 1997

§ 102(e) Date: Dec. 22, 1997

[87] PCT Pub. No.: WO96/33106

PCT Pub. Date: Oct. 24, 1996

[30] Foreign Application Priority Data

| | | | |
|---|---|---|---|
| Apr. 21, 1995 | [DE] | Germany | 195 14 277 |
| Jun. 3, 1995 | [DE] | Germany | 195 20 531 |
| Jun. 17, 1995 | [DE] | Germany | 195 22 073 |

[51] Int. Cl.[7] ..... B32B 3/12; A47B 95/00; B65D 85/48; B65D 81/02

[52] U.S. Cl. ..... 428/116; 108/27; 206/453; 206/586; 248/345.1

[58] Field of Search ..... 206/568, 453; 248/345.1; 108/22

[56] References Cited

U.S. PATENT DOCUMENTS

| | | | |
|---|---|---|---|
| 3,144,236 | 8/1964 | Clanin | 248/345.1 |
| 3,150,854 | 9/1964 | Jamieson | 248/345.1 |
| 3,446,345 | 5/1969 | Frosoy | 206/453 |
| 3,655,034 | 4/1972 | Stollman et al. | 206/586 |
| 3,960,354 | 6/1976 | Simikoski | 206/586 |
| 4,000,843 | 1/1977 | Sorensen et al. | 206/586 |
| 4,063,702 | 12/1977 | Wilde et al. | 206/586 |
| 4,127,192 | 11/1978 | Card | 206/586 |
| 4,134,496 | 1/1979 | Smith | 206/586 |
| 4,194,630 | 3/1980 | Kaiser | 206/586 |
| 4,801,018 | 1/1989 | Wilde . | |
| 4,951,821 | 8/1990 | Kempkes | 206/453 |
| 5,071,009 | 12/1991 | Ridgeway | 206/586 |
| 5,175,041 | 12/1992 | Webb et al. . | |

FOREIGN PATENT DOCUMENTS

| | | | |
|---|---|---|---|
| 571 759 | 3/1933 | Germany | 206/453 |
| 28 27 846 | 9/1979 | Germany . | |
| 2951402A1 | 6/1981 | Germany . | |
| 4232155A1 | 3/1994 | Germany . | |
| 9404531 | 6/1994 | Germany . | |
| 4137809C2 | 11/1994 | Germany . | |
| 4318045A1 | 12/1994 | Germany . | |
| 4440196A1 | 6/1995 | Germany . | |
| 380271 | 5/1940 | Italy | 206/453 |
| 1 458 872 | 12/1976 | United Kingdom . | |
| 2 221 942 | 2/1990 | United Kingdom | 206/586 |

*Primary Examiner*—Mark L. Bell
*Assistant Examiner*—J. Pasterczyk
*Attorney, Agent, or Firm*—Jones, Tullar & Cooper, P.C.

[57] ABSTRACT

The present invention relates to a device for padding corners of, for example, equipment housings. The device has two arms joined to each other at an angle and cheeks. The cheeks are fitted to the outside of the arms. To enable a device of this kind to be used in a variety of applications, i.e., over a wide range of housing sizes, and still remain firmly in place, each arm of the device has a honeycomblike structure designed so that it can be stretched in the lateral direction of the device.

23 Claims, 4 Drawing Sheets

CORNER-PROTECTION PAD

FIELD OF THE INVENTION

The present invention relates to a device for padding corners of bodies, for instance on equipment housings, having two arms joined to each other at an angle and having cheeks disposed on the outside of the arms, the arms having longitudinally extending through holes.

BACKGROUND OF THE INVENTION

Known devices of this kind, as known from U.S. Pat. No. 4,801,018 and also known as padded corner protectors and made from a suitable plastic, are all embodied rigidly and adapted to the applicable shape, and in particular the width, of the particular body or housing. This means that for each housing width, one specially dimensioned padded corner protector has to be manufactured and kept in inventory. This is not only expensive financially but also time-consuming in packaging.

From German Patent Disclosure DE 29 51 402 A1, it is known to embody protective covers for articles of the most various sizes, but in that reference the arms are shaped meanderingly between the cheeks, which is complicated and expensive to manufacture, requires considerable space, and does not lead to a good padding effect.

SUMMARY OF THE INVENTION

The object of the present invention is therefore to provide a device for padding body corners of equipment housings, for instance, as noted at the outset, which can be used in manifold ways, in other words on body edges over a particular width range and conforms tautly to it yet is nevertheless simple to manufacture.

To attain this object, in a device for padding corners of bodies, for instance of the equipment housings, of the type referred to, each arm has a honeycomblike structure that can be elastically stretchable in its transverse direction.

As a result of the provisions of the present invention it is possible to cover various widths of equipment housings, furniture regions and the like that are to be covered or padded over a certain range of width differences, for instance from 60 to 100 mm. Because of the elastic stretchability of the structure, which is like a honeycomb, i.e., honeycomblike, the device can rest with initial tension on the body corners or the side regions thereof, thus assuring that the device will hold tautly in every case to the applicable body corner. Easy manipulation is assured, for instance for further packing of the housing or the like in a cardboard box. The device can be produced economically in terms of expense and material.

An advantageous embodiment of the honeycomblike structure of the arms is that the arms have at least two honeycomblike elements whose through openings, which extend vertically to the longitudinal and transverse extensions of the arms, have an inside diameter substantially greater than the thickness of the walls of the honeycomblike elements, and the two honeycomblike elements, disposed side-by-side in the direction of the transverse extent, are joined together by at least one expansion rib. When the arms are pulled apart, or by means of the cheeks, the two honeycomblike elements disposed side by side in each arm can deform in such a way that they become larger in their transverse extension and smaller in their longitudinal extension. Because of the elasticity of this shape change, an initial tension is produced by means of which the cheeks rest tautly against the side regions of the body corners to be protected. It will be understood that it is also possible to form the arms from more than two side-by-side honeycomblike elements, depending on the width of the body corner to be covered and on the elasticity of the material used.

To further improve and increase the range of elasticity of the individual honeycomblike elements or of the entire arm, the honeycomblike elements are embodied as at least partly curved on at least their inner wall, in which curved region the one expansion rib is disposed, with the inside wall of the honeycomblike element being concave and the expansion rib is embodied as curved, preferably convex on the outside are contemplated, individually or in combination.

Features of the honeycomblike elements reside in that they are rounded on their free face-end region and/or are provided with beveled inner and faces on their outer free region with narrow end walls extending vertically to these end faces, and in the latter case, optimal tool unfolding in manufacture is made possible.

A further increase in elasticity and hence an increase in the range of widths of body corners to be protected that has to be covered are offered in that between the pairs of honeycomblike elements of each arm, one web corner element is formed, which extends from the expansion rib of the one arm to the expansion rib of the other arm and whose inside diameter is substantially greater than the thickness of its wall.

With the spacer ribs provided in the connecting region of the two arms and inside the web corner element it is attained that sagging or in other words canting of the cheeks pressing around the body corners to be protected, is avoided, so that a large-area prestressing force is always present between the cheeks and the side regions of the body corners to be protected.

Suitably, the arms have an inclined face on the outside of the connecting region, and the two arms are embodied identically.

Further expedient embodiments of the device for padding body corners of equipment housings, for instance, will become apparent from the discussion that follows.

Further details of the present invention may be learned from the following description, in which the present invention is described and explained in further detail in terms of the exemplary embodiments shown in the drawing.

DESCRIPTION OF THE PREFERRED EMBODIMENTS

Figure 2:
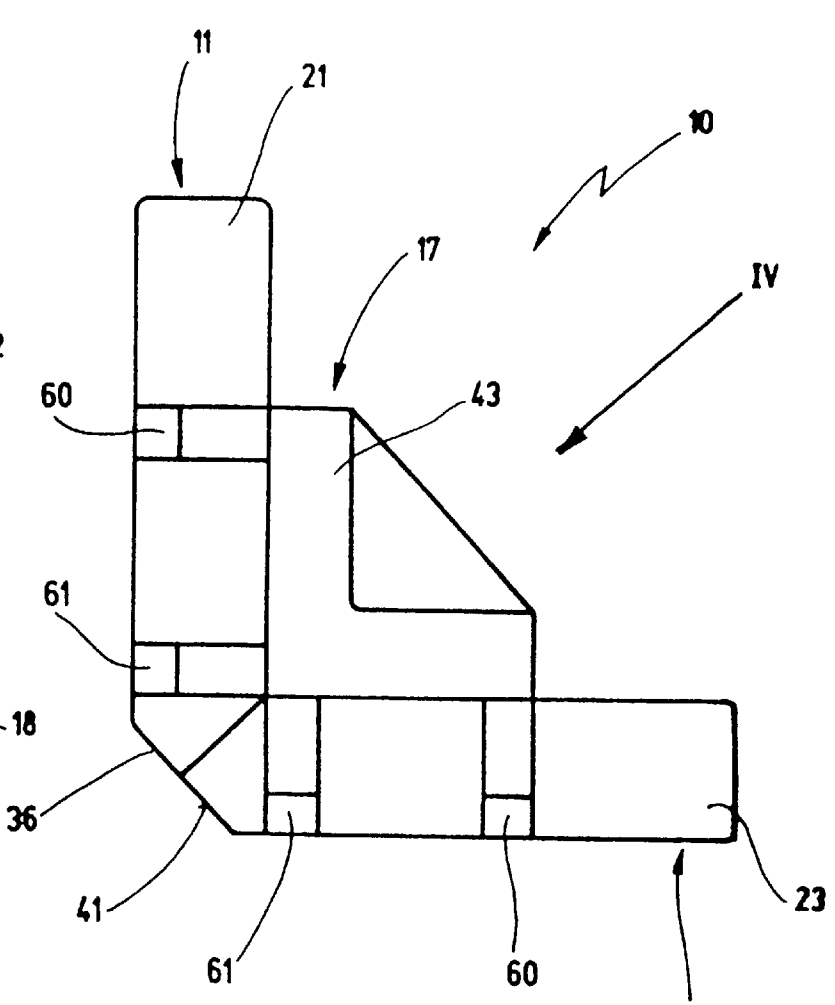
FIG. 2, is a side view in the direction of the arrow II of FIG. 1.
Figure 1:
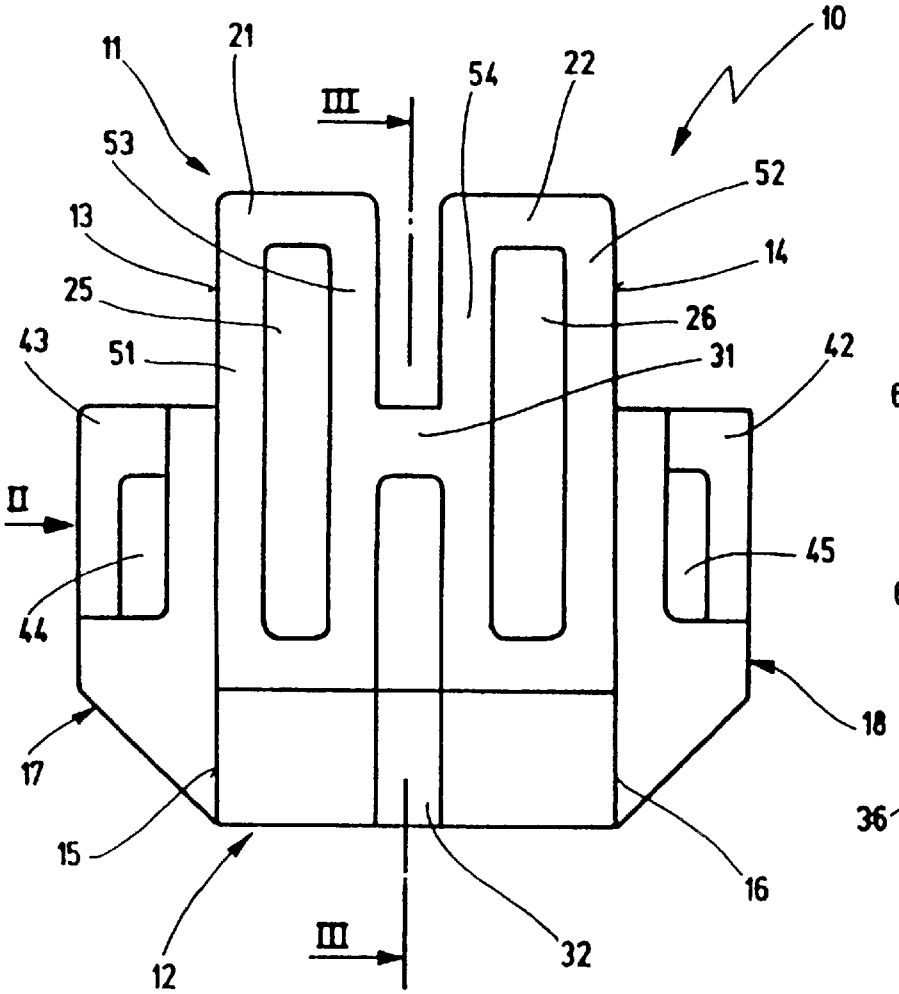
FIG. 1, is a front view of a device, hereinafter called a padded corner protector, is for padding body corners in accordance with a first exemplary embodiment of the present invention.
Figure 4:
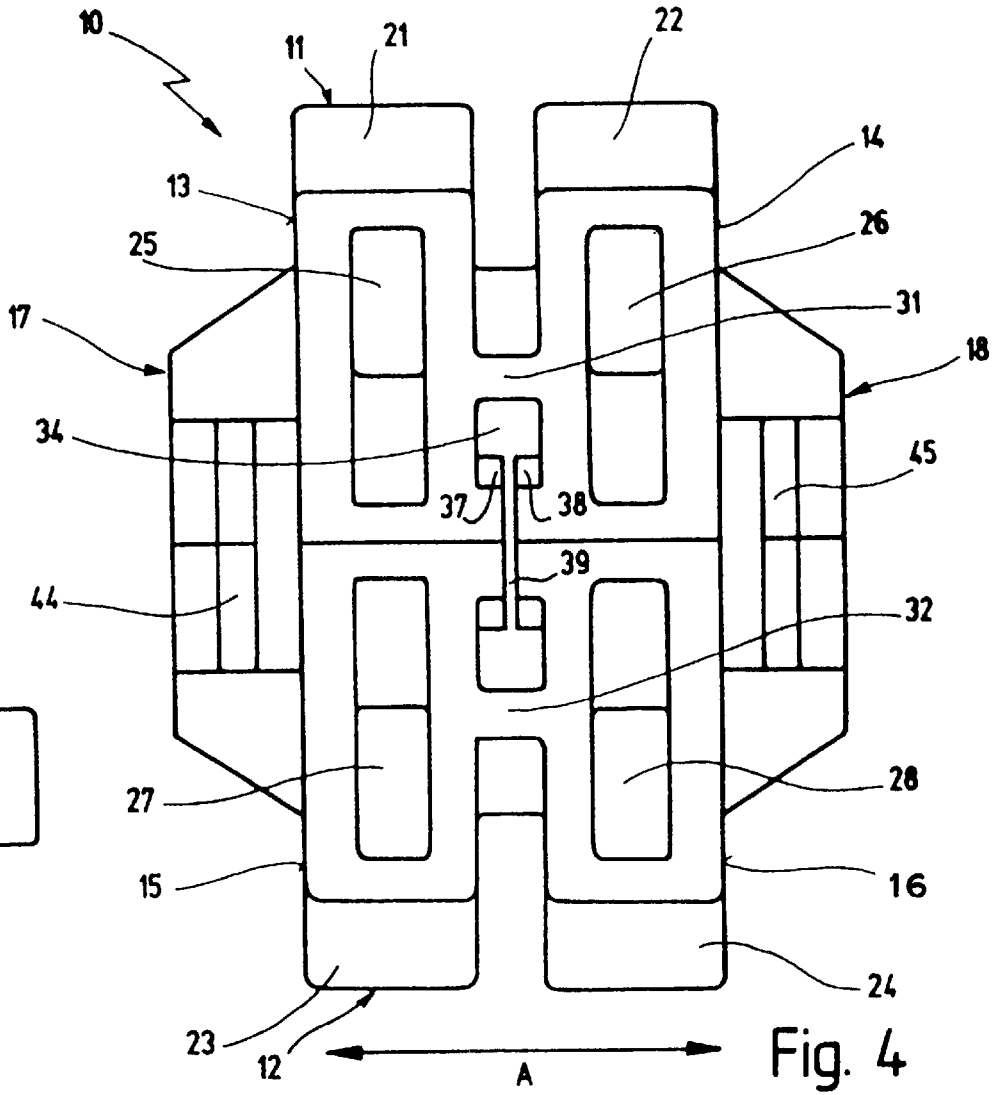
FIG. 4, is a view in the direction of arrow IV of FIG. 2.

The device 10 or 10', shown in the drawing in terms of two exemplary embodiments of the present invention, for padding body corners of equipment housings, for instance, such as computer housings, furniture parts, and similar components requiring protection during transport, which device will hereinafter also be called a padded corner protector, is stretchable in its transverse extension, or in other words can be pulled apart elastically to different widths. As a result, with a single type of padded corner protector 10, 10', body corners of housings, items of furniture and the like of various widths can be covered or padded. The elastic stretchability leads to a contrary initial stress that rises in accordance with the elastic stretching, so that the padded corner protector 10 or 10' is held in clamping fashion and tautly against the applicable body corner to be covered. The padded corner protector 10 or 10' is made in one piece, either by foaming using a suitable tool or by mechanical cutting, for instance using a water jet device. The padded corner protector 10 or 10' is of expandable polypropylene (EPP), for instance; however, it may also be made from polyethylene or a similarly elastic plastic material.

In FIGS. 1–4, the one-piece padded corner protector 10 has two arms 11 and 12, extending at angles to one another, of certain longitudinal dimensions, which are partly covered by a cheek 17, 18 on their respective outsides 13, 14; 15 and 16. In the exemplary embodiment shown, the two arms 11 and 12 form a right angle (see FIGS. 2 and 3); however, it will be understood that other angular arrangements of the arms 11 and 12 are also possible, if correspondingly shaped body corners are to be covered or padded. The cheeks 17 and 18 each cover the entire depth of the arms 11 and 12 as well as a portion, for instance approximately two-thirds, of the length of the respective adjacent arm 11, 12.

The two arms 11 and 12 are embodied identically, and the cheeks 17 and 18 are also identical to one another. Each arm 11, 12 has a structure with openings which is like a honeycomb, hence a honeycomblike structure, on the basis of which an elastic deformation in the direction A (see FIG. 4) of the transverse extension of the arms 11 and 12 is possible. Each arm 11, 12 has two honeycomblike elements 21 and 22; and 23 and 24, respectively, which are disposed side by side and each have the same embodiment or form and are spaced apart from one another. The honeycomblike elements 21–24 are disposed such that their openings 25–28 each extend in the depthwise direction, or in other words at right angles to the longitudinal and transverse extension of the honeycomblike elements. The openings 25–28 are wider than the walls of elements 21–24 are thick. The respective adjacent honeycomblike elements 21 and 22; and 23 and 24 are joined together by a respective expansion rib 31 and 32; the ribs 31, 32 extend approximately centrally of the longitudinal extension of the respective arm 11 and 12. In the exemplary embodiment shown, the honeycomblike elements 21 and 22; 23 and 24 are embodied as somewhat elongated rectangles in cross section and are provided with elongated rectangular through openings 25–28; that is, both the outer and the inner walls 51, 52 and 53, 54, respectively, of the honeycomblike elements 21–24 are embodied as uniformly thick and rectilinear. However, they may also become narrower conically toward the outside, to enable ideal "crimping" and hence optimal damping, which leads to a high G-value.

As a result of this arrangement of the honeycomblike elements 21–24, the two arms 11 and 12, and their connection by the ribs 31 and 32, a honeycomblike central corner element 34 is created, which extends in the transverse extension between the respective pairs of honeycomblike elements 21 and 22, 23 and 24 and in the longitudinal extension between the two ribs 31 and 32 past the corner connection region 36 of the arms 11 and 12 and demarcates a corresponding through opening 29. Inside this web corner element 34, spacer ribs 37 and 38 are provided in the corner connection region 36 on the two inside faces of the inner walls 53, 54 of the honeycomblike elements 21–24; the end faces of these spacer ribs have a slight spacing 39 from one another. In the elastic expansion in accordance with the double arrow A of the padded corner protector 10, the spacer ribs 37, 38 prevent the device from sagging open in an excessively wide V.

Figure 3:
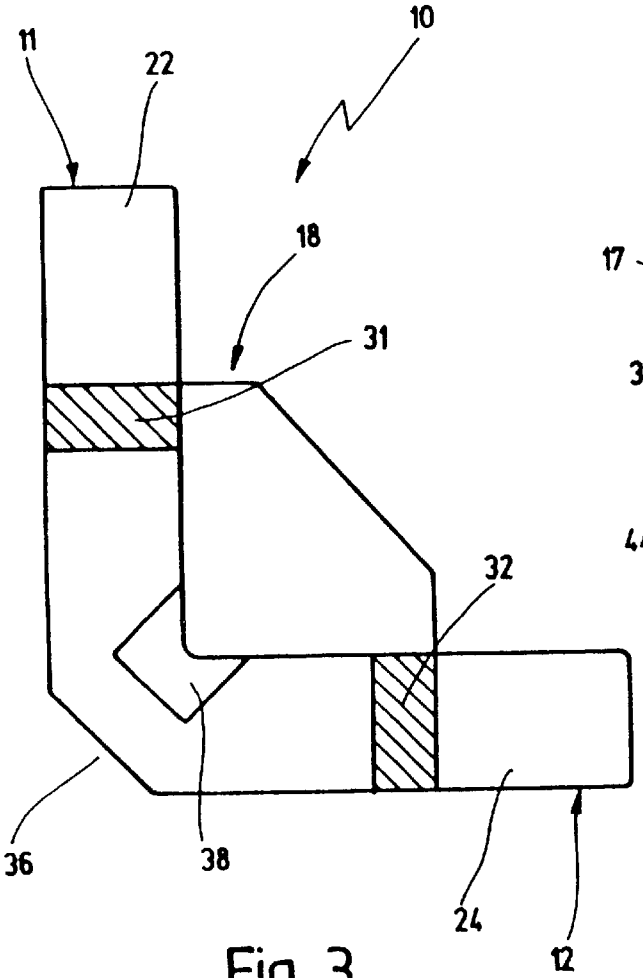
FIG. 3, is a section taken along the line III—III of FIG. 1.

As can be seen from FIGS. 2 and 3, the corner connection region 36 of the arms 11 and 12 is provided on its outside with an inclined face 41. The two cheeks 17 and 18, which are approximately trapezoidal in outline, are provided on their outside with approximately angle-bracketlike ears 42, 43, which extend from a front region of the cheeks 17 and 18. Between the angle-bracketlike ears 42 and 43 and the outsides of the arms 11, 12, two parallel gripping strips 44 and 45 are formed onto the cheeks 17 and 18; like the angle-bracketlike ears 42 and 43, these strips serve the purpose of cushioning or padding the body corners to be protected in the event of an impact from the side. Moreover, the arms 11, 12 are provided with additional padded ribs 60 and 61, with which optimal damping in the edge region can be attained.

For attaching such a padded corner protector 10 to a body corner of certain, equipment the padded corner protector 10 is pulled apart in the directions of the double arrow A at the gripping strips 44 or 45 of the two cheeks 17 and 18, thus increasing the inside spacing between the inner faces 47 and 48 of the two cheeks 17 and 18. When the arms 11 and 12 of the padded corner protector 10 are thus pulled apart in the directions of the double arrow A, the honeycomblike elements 21–24 are elastically stretched in the transverse extension in the region of the connecting ribs 31 and 32 and are deformed, pulling together, in the longitudinal extension. If the padded corner protector 10 is placed on a body corner to be protected, then under the influence of the prestressing of the padded corner protector caused by the stretching, the padded corner protector 10, with its inside faces 47, 48 of the cheeks 17, 18, comes into contact with the side faces of the body corner to be protected, so that the padded corner protector 10 is held in prestressed fashion and thus clampingly or tautly over the corner.

The second exemplary embodiment of a padded corner protector 10', shown in FIGS. 5–8, is essentially equivalent to the first exemplary embodiment of FIGS. 1–4, so that the same reference numerals, but provided with a prime, are used for the same components. A difference in the padded corner protector 10' of the second exemplary embodiment is the embodiment of the honeycomblike elements 21'–24' of the arms 11', 12'. The honeycomblike elements 21'–24' are not elongatedly rectangular in cross section but rather are partly concave and partly convexly rounded. While the outer walls 51' and 52' are rectilinear, the inner walls 53' and 54' of the honeycomblike elements 21'–24' extend toward the expansion rib 31', 32' and away from it in a concave shape pointing toward the outer wall 51' and 52', respectively. The free ends 55', 56', of the honeycomblike elements 21'–24' are rounded convexly at the corners. The expansion ribs 31' and 32' are curved convexly toward the free outer side of the arms 11', 12'. The openings 25'–28' are substantially greater in their inside diameter than the thickness of the walls 51'–54'. The expansion ribs 31', 32' centrally engage the convex region of the inner wall 53', 54'. All of this leads to an optimal elastic deformation of the honeycomblike elements 21'–24', or of all the arms 11', 12'.

Figure 6:
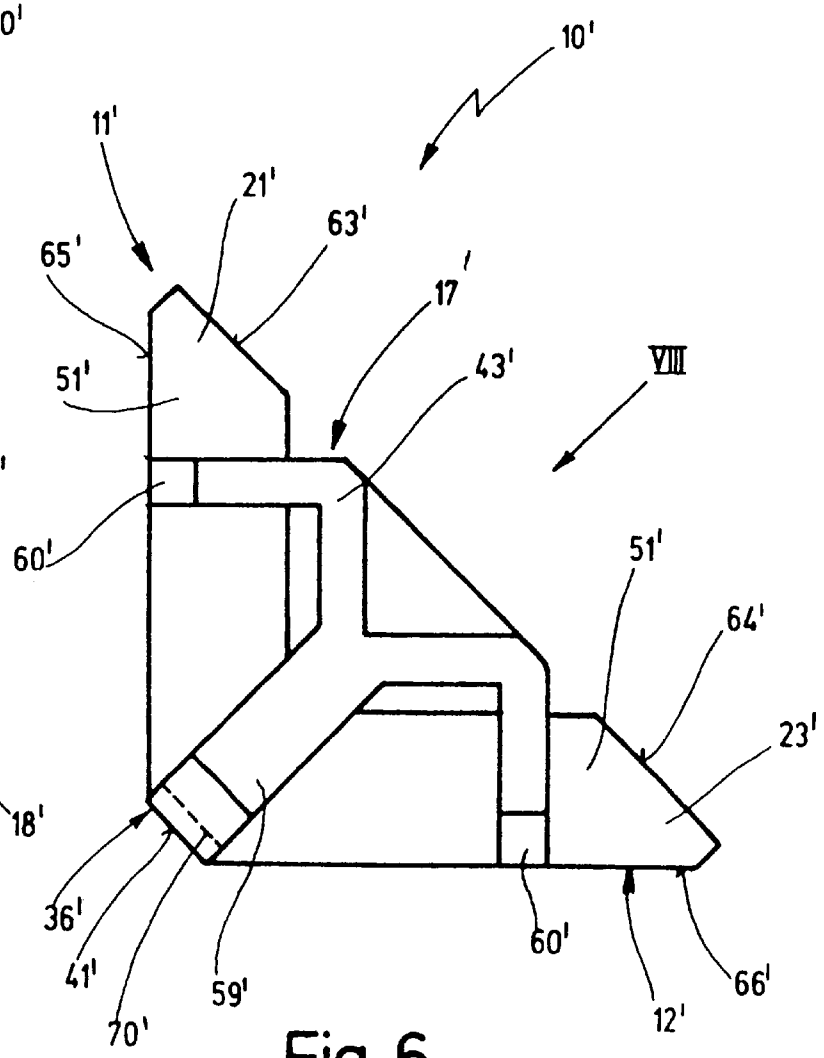
FIG. 6, is a side view in the direction of the arrow VI of FIG. 5.
Figure 5:
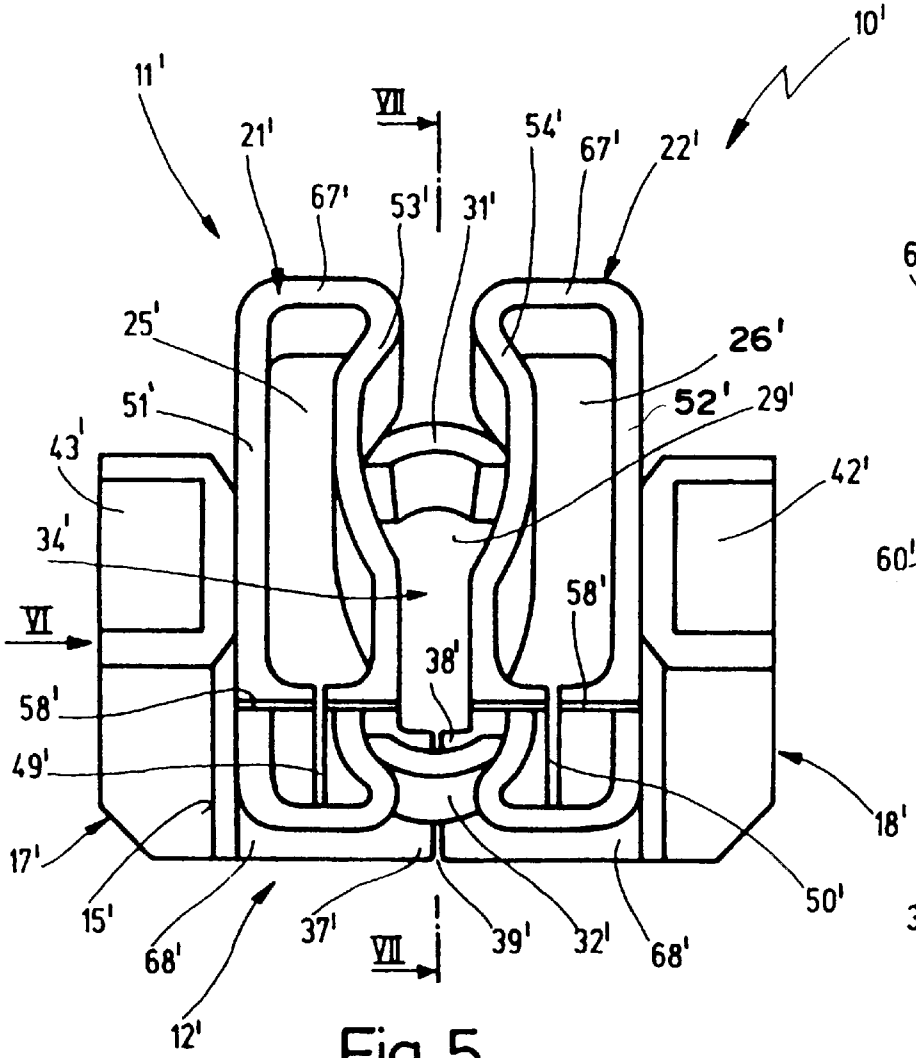
FIG. 5, is a front view, corresponding to FIG. 1, of a padded corner protector in a second exemplary embodiment of the present invention.
Figure 8:
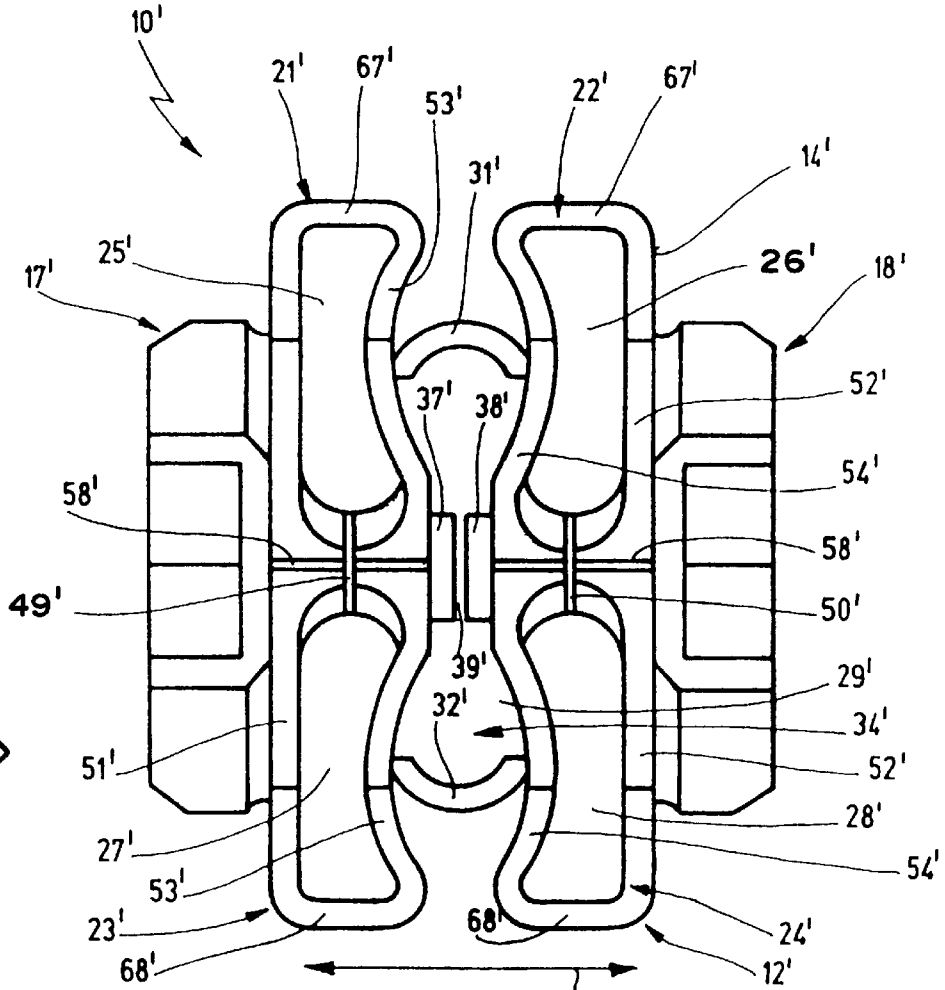
FIG. 8, is a view in the direction of arrow VIII of FIG. 6.
Figure 7:
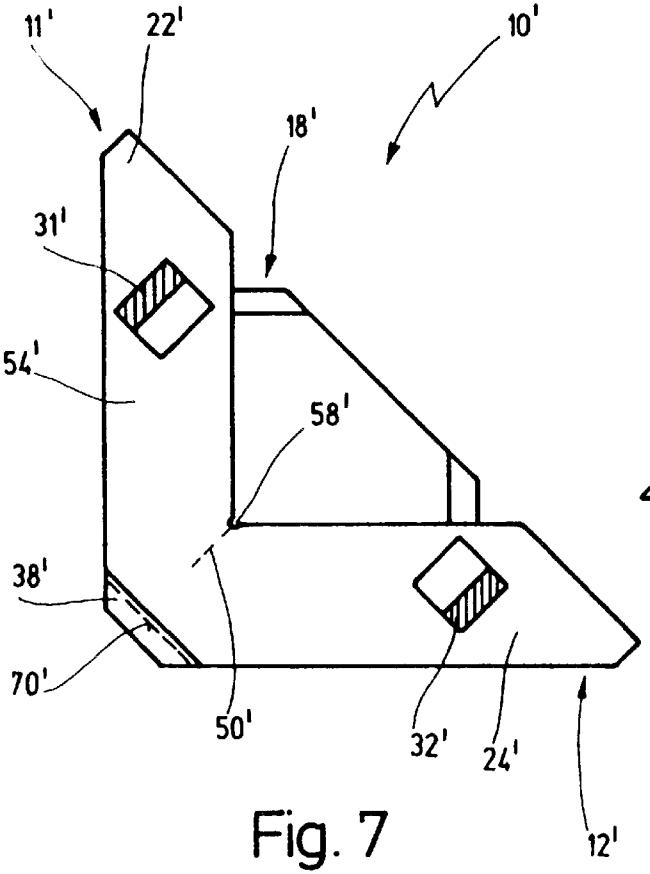
FIG. 7, is a section taken along the line VII—VII of FIG. 5.

Moreover, the honeycomblike elements 21'–24', as shown particularly in FIGS. 6 and 7, are provided in the region between the end of the cheeks 17', 18' and their own end with an inner end face 63' and 64', respectively, which extends obliquely to the respective outer end face 65' and 66' of the honeycomblike elements 21'–24'. The same is true for each narrow end wall 67', 68', connecting the inner and outer walls 51', 52', 53', 54', of the honeycomblike elements 21'–24', which end walls extend obliquely rearward, and hence at right angles to the rearward inclined face 41', between the inner end face 63', 64' and the outer end face 65', 66' of the inner and outer walls 51', 52', 53', 54'. This makes for easy manufacture and unmoldability of the corner pad 10' from the applicable tool.

In this second exemplary embodiment of the padded corner protector 10', the connecting ribs 31', 32' between the honeycomblike elements 21'–24' are disposed extending obliquely, corresponding to the narrow end walls 67', 68'. The connecting ribs 31' and 32' are present only in a middle region of the depth of the inner walls 53', 54' of the honeycomblike elements 21'–24', for the sake of saving material and for the sake of easier deformability.

In this exemplary embodiment, the two spacer ribs 37' and 38' are placed toward the inclined face 41', with which they are aligned on the outside; the end faces of the spacer strips 37' and 38' face one another at a slight spacing 39'.

In FIG. 6, the inner edge of the corner connection region 36' of the two arms 11' and 12' is provided with a hollow throat 58' extending crosswise of the arms, in order to reduce the risk of tearing or breakage. In addition, a respective narrow groove 49' and 50' extending over part of the depth is provided between the adjacent honeycomblike elements 21' and 23', and 22' and 24', respectively, in the corner connection region 36'.

The web corner element 34' is thus obtained, with its opening 29' between the curved connecting ribs 31', 32', the inner walls 53', 54' of the elements 21'–24' and the spacer ribs 37', 38'.

Moreover, the cheeks 17' and 18' are each provided with angular ears 42', 43' and padded strips 60', 61' extending at an angle outward from them. Extending from the corner of the angular ears 42' and 43', approximately at right angles to the inclined face 41', is an impact strip 59', which forms a gripping strip on each side of the padded corner protector 10'. Another opportunity for gripping is presented by recesses 70'in the inclined face 41' on both sides of the spacer slit 39', as shown in dashed lines in FIG. 6. These recesses 70' at the same time serve to increase shock absorption in this region.

The two cheeks 17' and 18' may be provided, on their free edges facing one another, with a chamfer for the sake of easier placement on a housing corner.

In accordance with a further exemplary embodiment of the present invention, not shown, each arm 11, 12 or 11', 12' of a respective padded corner protector 10 or 10' has more than two side-by-side honeycomblike elements joined together by a rib.

What is claimed is:

1. A device for padding body corners, comprising:

two arms joined to each other at an angle, each arm having a longitudinal extent and a transverse extent, said transverse extent terminating at a transverse end of the device, with at least two longitudinally extending through openings formed in each arm in the transverse direction, and an expansion rib connecting said at least two longitudinally extending through openings; and a cheek disposed on the outside of and between each arm at each transverse end of the device, wherein:

said through openings form a honeycomb-like structure in its respective arm, with each arm forming thereby two honeycomb-like elements, said honeycomb-like elements define an inner wall which are at least partly of arcuate shape at their inner wall, said expansion rib being arranged to connect said longitudinally extending through openings at said inner wall of each, and said two arms are elastically expandable in the direction of their transverse extent for adaptation to different body corner widths.

2. The device as defined in claim 1, wherein the opening extent of each through opening is substantially greater than the thickness of said honeycomb-like elements.

3. The device as defined in claim 1, wherein said inner wall is concave.

4. The device as defined in claim 1, wherein said expansion rib has an arcuate shape which is convex toward the outside of the center of the device.

5. The device as defined in claim 3, wherein each honeycomb-like element defines a free end which is rounded.

6. The device as defined in claim 2, wherein each honeycomb-like element defines an outer free region, having beveled inner end faces and narrow end walls running perpendicular thereto.

7. The device as defined in claim 2, further comprising:

a honeycomb-like corner element which extends from said expansion rib of one pair of arms to the expansion rib of the other pair of arms, each honeycomb-like corner element having an opening the extent of which is substantially greater than the thickness of said wall.

8. The device as defined in claim 7, further comprising:

a pair of spacer webs, one on each arm and in the connecting region of said two arms inside said honeycomb-like corner element.

9. The device as defined in claim 8, wherein each arm has at the outside of said connecting region, an oblique face.

10. The device as defined in claim 9, wherein said spacer webs form the inner extension of said oblique face.

11. The device as defined in claim 10, wherein groove-like recesses are provided in said oblique face.

12. The device as defined in claim 1, wherein each cheek is provided with an ear-like projections.

13. The device as defined in claim 1, wherein at least one of said cheeks is provided with gripping strips.

14. The device as defined in claim 1, further comprising:

an obliquely running peg-like damping element, wherein the connection of an arm and cheek defines a region of transition, and wherein said obliquely running peg-like damping element is provided in said region of transition.

15. The device as defined in claim 1, wherein said honeycomb-like elements have narrow end walls, and wherein said expansion web has an extent which is parallel to the extent of said narrow end walls.

16. The device as defined in claim 1, wherein said joined arms form an arm connection region associated with adjacent honeycomb-like elements, and wherein a longitudinally extending groove-like slot is formed in said arm connection region in association with each honeycomb-like element, and which extends from an inner edge of said opening of its associated honeycomb-like element.

17. The device as defined in claim 1, wherein each honeycomb-like element defines an inner edge, and wherein a channel is provided in said inner edge.

18. The device as defied in claim 1, further comprising:

a padding rib associated with each arm, wherein each arm defines an edge region, and wherein each joined arm is provided with a padding rib.

19. The device as defined in claim 1, wherein the device is foamed in a mold.

20. The device as defined in claim 1, wherein the device is formed by cutting.

21. The device as defined in claim 20, wherein said cutting is by water jet.

22. The device as defined in claim 1, wherein the device is formed from an elastic plastic.

23. The device as defined in claim 22, wherein the plastic is polypropylene.

* * * * *